United States Patent [19]

Wicksell et al.

[11] 4,204,693

[45] May 27, 1980

[54] DEVICE FOR WAXING SKIS

[76] Inventors: Hans Å. Wicksell, Trestegsgatan 63, 603 63, Norrköping; Stig Ståhl, Jägmästargräand 4, 574 00; Ingemar G. Löfstedt, Sjunnan, 574 00, both of Vetlanda, all of Sweden

[21] Appl. No.: 893,816

[22] Filed: Apr. 5, 1978

[51] Int. Cl.[2] ..... A63C 11/08

[52] U.S. Cl. ..... 280/809 T; 401/1; 401/193

[58] Field of Search ..... 401/1, 2, 3, 193; 222/146 R; 280/11.37 T

[56] References Cited

U.S. PATENT DOCUMENTS

| | | | |
|---|---|---|---|
| 410,330 | 9/1889 | Porterfield et al. | 401/1 |
| 2,257,316 | 9/1941 | Votaw et al. | 401/193 |
| 3,950,105 | 4/1976 | Moss et al. | 401/2 X |
| 3,968,345 | 7/1976 | Kollmeder | 280/11.37 T |

FOREIGN PATENT DOCUMENTS

| | | | |
|---|---|---|---|
| 817512 | 8/1951 | Fed. Rep. of Germany | 401/193 |
| 2422159 | 11/1975 | Fed. Rep. of Germany | 401/193 |
| 2638548 | 9/1977 | Fed. Rep. of Germany | 280/11.37 T |
| 2267807 | 11/1975 | France | 280/11.37 T |
| 86396 | 7/1920 | Switzerland | 401/1 |
| 185445 | 7/1936 | Switzerland | 280/11.37 T |

*Primary Examiner*—Edgar S. Burr
*Assistant Examiner*—Steven A. Bratlie
*Attorney, Agent, or Firm*—Neil F. Markva

[57] ABSTRACT

A device for waxing skis comprises a rectangular metal block forming a base-plate having ribs extending along the side edges and upstanding above the upper surface. A metal end plate is fixed to one end so as to protrude above the upper surface and below the lower surface of the base-plate. A plurality of shallow grooves in the end edge adjacent the end plate extends between the lower surface and upper surface and diverges toward the latter in width and depth. The base-plate also carries a handle assembly projecting upwardly away from the end opposite to the end plate. The upper surface of the base-plate together with the side ribs and end plate define a recess for containing melted wax which passes through the grooves when being applied and spreads evenly over the running surface of the ski. A guide member is disposed along one side of the base-plate and protrudes downwardly so as to be adapted to engage an edge of the ski during the waxing operation.

4 Claims, 3 Drawing Figures

DEVICE FOR WAXING SKIS

FIELD OF THE INVENTION

This invention relates to a device for waxing skis and applies to a type of device suitable for the application of wax to the surface of both wood and plastic skis.

BACKGROUND OF THE INVENTION

Waxing of skis is generally carried out by applying the wax directly to the surface of skis from a tube or tin and then smoothing out the wax into an even film using a block of plastics material together with heat generated by friction after, if necessary, having previously applied heat directly to the ski from, for example, a gas blow-torch.

When waxing plastic skis, it is particularly important that the heat is not applied by using a flame directly against the ski. Heretofore this has caused some problems in that waxing devices previously known have required that the wax be first applied to the ski and then be smoothed out evenly over the running surface of the ski.

SUMMARY OF THE INVENTION

The present invention provides a device for waxing skis which includes a metal body of special form which can be heated and to which the wax can be applied so as, by virtue of its particular design, can be spread and applied simultaneously to the ski without the ski having to be subjected to sufficient heat to cause it to be weakened or deformed.

More particularly, the waxing device which is the subject of this invention has a form and characteristics as defined in the appended patent claims.

BRIEF DESCRIPTION OF THE DRAWINGS

By way of example, a preferred embodiment is illustrated in the accompanying drawings in which.

DETAILED DESCRIPTION OF THE PREFERRED EMBODIMENT

Figure 2:
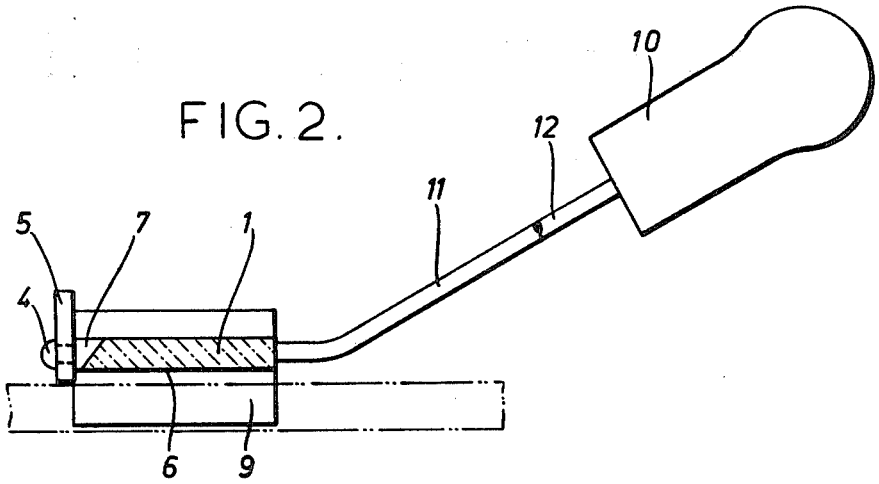
FIG. 2 is a longitudinal sectional view along line II—II of FIG. 1.
Figure 1:
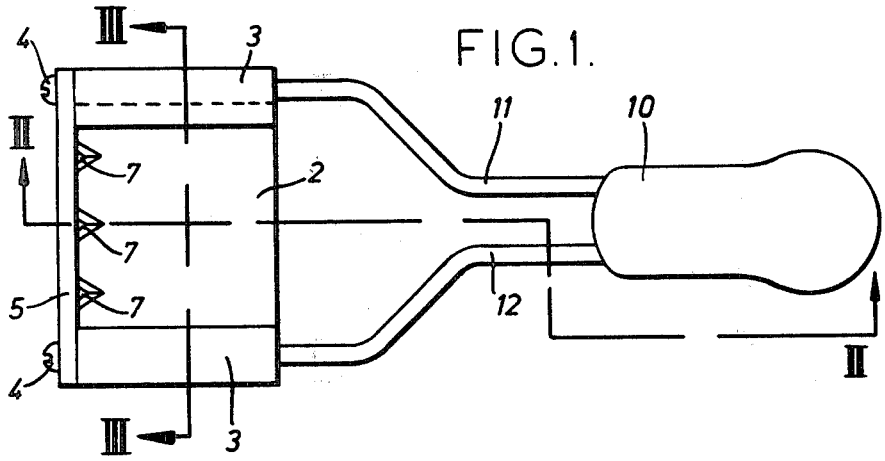
FIG. 1 is a plan view of the waxing device of this embodiment.

In the form of construction illustrated, the waxing device comprises a metal base-plate 1 in the form of a preferably rectangular block having raised ridges or ribs 3 extending along both of the shorter side edges and upstanding above the upper surface 2. A rectangular metal end plate 5 is fitted with fixing screws 4 to one end edge of base-plate 1 so as to lie at right angles to the plane of the latter. An upper longitudinal edge of the metal end plate 5 protrudes somewhat above upper surface 2 and its opposite lower longitudinal edge protrudes somewhat below lower surface 6.

Also, along its front end edge adjacent the end plate 5, the base-plate 1 has a plurality of shallow notches or grooves 7 which diverge towards upper surface 2. A guide member 8 is disposed along one side edge of base-plate 1 and has an inner face 9 lying in a plane at right angles to lower surface 6. Guide member 8 is adapted to provide support and guidance along the outer edge of the ski. As shown, end plate 5 forms a side of said grooves.

Base-plate 1 also includes a handle 10 connected by two rods 11 and 12 which have a circular cross-section and are fixed in slots or grooves 13 extending along the shorter sides of base-plate 1.

Figure 3:
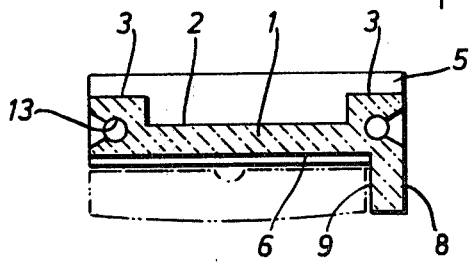
FIG. 3 is a transverse sectional view along line III—III of FIG. 1.

The device is used as follows. First, the metal base-plate 1 is heated and the device is applied to the underside of the ski (shown in broken lines in FIGS. 2 and 3) preferably at an oblique angle of a few degrees to the ski undersurface. Wax is then applied to the waxing device in the recess or space defined by the upper surface 2 of the base-plate, the end plate 5 and the edge ribs 3. Thus, the wax is melted by the heat from base-plate 1 and runs down through notches or grooves 7 onto the underside of the ski. At the same time, the waxing device is moved slowly along the length of the ski thereby causing the wax to be distributed evenly along the whole of the running surface of the ski.

When the whole of the running surface has been given an even layer of wax, the edge of the guide member 8 furthest from the handle assembly 10, 11, 12 may be passed along the flute on the ski so that the bottom of the flute is also covered by a layer of evenly spread wax.

It will of course be understood that the scope of the invention is not limited only to the form of construction shown by way of example in the accompanying drawings. Many modifications may be made within the scope of the appended claims, among the modifications which can be introduced if desired it may be mentioned that thermostatically controlled electrical heating means or means for heating by solid fuel tablets or the like can be incorporated in the base-plate.

We claim:

1. A device for waxing skis comprising:

(a) a prismatic base-plate composed of metal and having opposed first and second end edges, opposed first and second side edges, an upper surface, a lower surface, and ribs extending along said side edges and upstanding above said upper surface;

(b) a handle projecting from said base-plate;

(c) an elongate metal end plate which is fitted to one end edge of the base-plate and which has an upper longitudinal edge protruding above said upper surface of the base-plate and a lower longitudinal edge protruding below said lower surface of said base-plate, said end plate together with said ribs and upper surface of the base-plate defining a recess for containing melted wax;

(d) aperture means extending through said base-plate between said upper and lower surfaces thereof adjacent said end plate for passage of said melted wax; and (e) a guide member disposed along one side edge of the base-plate and protruding downwards below the lower surface thereof.

2. A device according to claim 1, wherein the guide member protrudes below the lower longitudinal edge of the end plate and is effective to engage an edge of an upturned ski when the device is applied to said ski in carrying out a waxing operation.

3. A device according to claim 1, wherein the base-plate is a metal block of substantially rectangular form and said handle projects upwardly away from the end edge opposite to said one end edge to which the end plate is fitted.

4. A device according to claim 1, wherein the aperture means comprises a plurality of shallow grooves in said end edge of the base-plate to which the end plate is fitted, said grooves diverging in width and depth towards said upper surface, said end plate forming a side of said grooves.

* * * * *